United States Patent [19]

Gustafson et al.

[11] 4,149,682

[45] Apr. 17, 1979

[54] ROLL HANDLING EQUIPMENT

[76] Inventors: Stanley Gustafson, 22 Alpine Close, Croydon, CRO 5UN; Dennis R. Impey, 281 Runley Rd., Luton, Bedfordshire; Anthony J. Sissons, 22 Alpine Close, Croydon, CRO 5UN, all of England

[21] Appl. No.: 631,228

[22] Filed: Nov. 12, 1975

[30] Foreign Application Priority Data

Nov. 13, 1974 [GB] United Kingdom ..... 49097/74

[51] Int. Cl.[2] ..... B65H 75/18

[52] U.S. Cl. ..... 242/72.1

[58] Field of Search ..... 242/72 R, 68.2, 72.1, 242/68.3, 68.1; 279/2

[56] References Cited

U.S. PATENT DOCUMENTS

| | | | |
|---|---|---|---|
| 1,016,738 | 2/1912 | Curry | 242/72.1 |
| 1,171,417 | 2/1916 | Esenko | 242/72.1 |
| 2,280,370 | 4/1942 | Bennett | 242/72.1 |
| 2,381,301 | 8/1945 | Markle | 242/72 |
| 2,670,905 | 3/1954 | Grauer | 242/72.1 |
| 2,891,739 | 6/1959 | Wolfe | 242/72 X |
| 3,224,701 | 12/1965 | Wynne | 242/68.1 |

*Primary Examiner*—Edward J. McCarthy
*Attorney, Agent, or Firm*—Bruce G. Klaas

[57] ABSTRACT

Roll handling apparatus comprising a rotatable body having peripherally spaced axially extending mounting surfaces inclined to the axis of rotation; a plurality of cylinder-engaging elements adapted to be received within a hollow cylinder and to engage the inner surface of the cyliner and movable relative to said mounting surfaces between a radially inner configuration and a radially outer configuration to engage the inner surface of the cylinder; actuating means, having an abutment surface extending radially outwardly beyond said elements and located for engagement with a side surface of the hollow cylinder during association of said elements within the hollow cylinder, for acting on said elements to move them relative to the mounting surfaces between said radially inner and outer configurations; and spring means for biasing said elements axially into their radially inner configuration.

24 Claims, 4 Drawing Figures

Schematic drawing showing method of operation

ROLL HANDLING EQUIPMENT

The present invention relates to roll-handling equipment and provides an expanding chuck for use in such equipment especially, but not exclusively, in the paper industry.

Paper and certain other web materials for industrial use usually are stored in the form of large rolls in which the web material is wound about a hollow cylindrical core or is wound about a mandrel which is subsequently removed to leave a core-less roll (i.e. one in wich the innermost windings constitute a core). As used hereinafter, the word "core" includes the innermost windings of a core-less roll unless the context clearly implies otherwise. During the winding of a roll for storage or its subsequent unwinding for use, it is necessary to support the core for rotation about its longitudinal axis. Such support is provided by chucks engaging the inner surface of the core. These chucks can be mounted on or integral with a rotatable shaft extending, for example, through the core. Alternatively, the chucks are shaftless in that they are carried by respective rotatable flanges or the like disposed adjacent the ends of the core so that the chucks extend into and engage the core immediately adjacent said ends.

Various designs of chuck are presently available but none are entirely satisfactory, especially for use with relatively soft cores such as those of cardboard, paper or fibre. The problems frequently encountered with known chucks include splitting of the core with consequential damage to web material in the innermost windings and failure to provide adequate engagement with the core to prevent slipping of the roll during braking by the chuck. Chucks presently in use include non-expanding tapered chucks, air expanding chucks, centrifugally expanding chucks and so-called "tilt-lock" chucks in which spring actuated teeth extend from the chuck body to engage the core.

It is an object of the present invention to provide an expanding chuck of relatively simple mechanically-operated design which will at least reduce the risk of encountering the problems referred to above.

According to the present invention therefore, there is provided an expanding chuck for engaging the inner surface of a hollow cylinder, which chuck comprises a rotatable body having peripherally spaced axially extending support surfaces inclined to the axis of rotation;

a plurality of cylinder-engaging elements abutting and movable axially over said support surfaces between a radially inner configuration and a radially outer configuration to engage the inner surface of the cylinder;

an actuating member acting on said elements to move them axially over the support surfaces between said radially inner and outer configurations; and spring means biassing said elements axially into their radially inner configuration.

In use, the chuck of the invention is inserted into the cylinder with the cylinder-engaging elements maintained in their radially inner configuration under the bias of the spring means. The actuating member is then moved to expand the elements towards their radially outer configuration into engagement usually, but not necessarily, frictional, with the inner surface of the cylinder. The said member is maintained in position to retain the elements in such engagement until it is desired to remove the chuck, whence the actuating member is released allowing the elements to return to their radially inner configuration under the spring bias.

The novel chuck has particular application to the handling of rolls of web material and hence it is preferred that the chuck should be adapted to fit in and engage the cores of such rolls. Usually such cores have an internal diameter of 3 or 4 inches and accordingly said preferred chucks are suitably dimensioned for use with one or the other of said core diameters.

The body of the chuck can be adapted for mounting on a shaft or can be integral with a shaft. In the case of a through shaft, an axially spaced pair of chucks usually will be provided. The body can alternatively be adapted for so-called "shaftless" operation by for example, provision of flange, stub-shaft or integral shaft mountings. Said means of mounting a chuck are known per se for existing chucks and the chuck of the invention can be adapted for use in an analogous manner to existing chucks. It is preferred however that the body should be adapted for connection in a shaftless mill roll stand.

The body can be of any shape but preferably is cylindrical. It is preferred also that the support surfaces are constituted by the bases of axially extending keyways (i.e. grooves) peripherally spaced about the body. Those bases suitably are planar and tangential to the axis of rotation. The support surfaces are inclined to the said axis and diverge therefrom in an axial direction either away from or, preferably, towards the axially outer end of the body with respect to the intended position of the chuck within the cylinder to be engaged.

The cylinder engaging elements are movable axially over the support surfaces and preferably are of generally triangular shape in axial cross-sections so that the radially outer (i.e. cylinder engaging) surface of each element extends axially of the body throughout movement between the radially inner and outer configurations. Said radially outer surfaces can be smooth or irregular, e.g. fluted, to increase frictional engagement with the inner surface of the cylinder to be engaged. Preferably, that surface is part-cylindrical of a radius substantially equal to the internal radius of said cylinder. It is preferred also that the elements are equally spaced circumferentially of the axis of rotation and are four or six in number.

The actuating member can be an annular member slidably received on the body for axial movement relative thereto. In such a case, the cylinder-engaging elements can be adapted to engage the annular member for axial movement therewith at least in the direction of the radially outer configuration of said elements. For example, the annular member can have a radially extending recess or groove in which a radially extending projection of each cylinder-engaging element is located. Conveniently, the actuating member is adapted to abut the end of the cylinder to be engaged and to be retained thereby whilst the body of the chuck is moved further into the cylinder.

The spring means can act directly on the cylinder-engaging elements or on the actuating member and can comprise helical compression springs acting between said element or member and the body.

The following is a description by way of example only and with reference to the accompanying informal drawings of a chuck in accordance with a preferred embodiment of the present invention. In the drawings.

Figure 1:
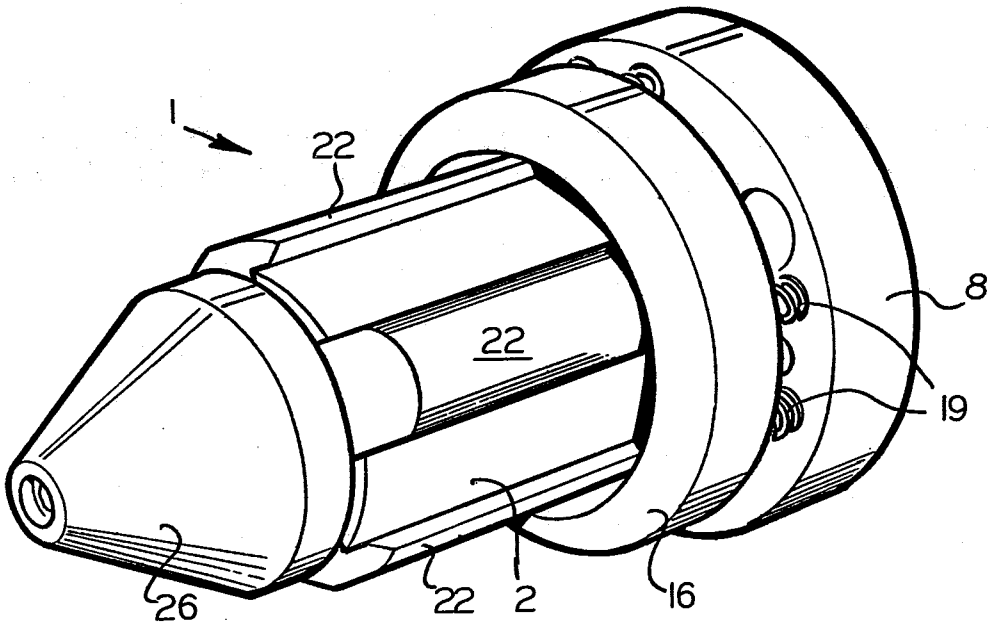
FIG. 1 is a front perspective view of a shaftless chuck for use with a shaftless mill roll stand for unrolling rolls of paper.
Figure 2:
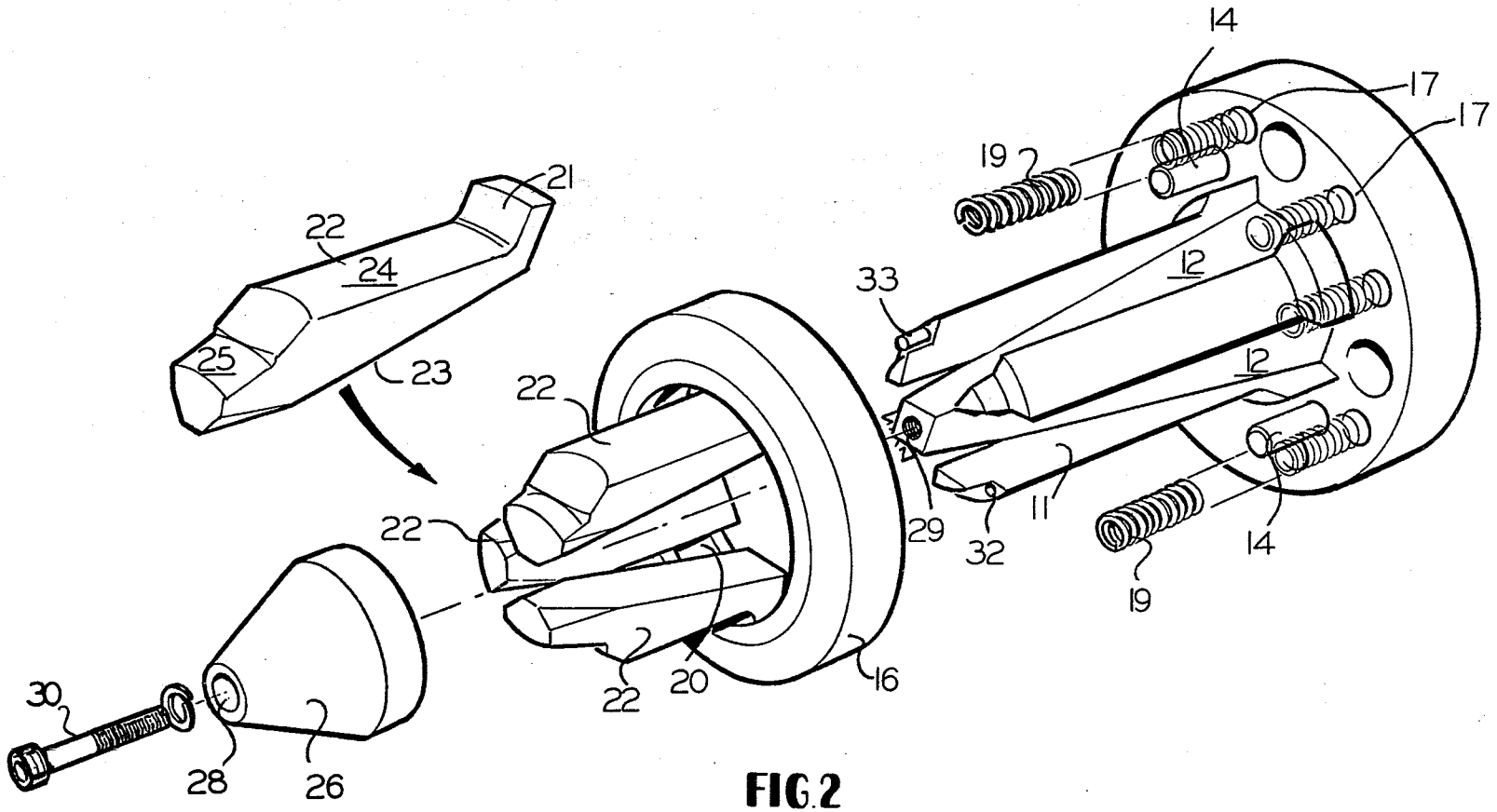
FIG. 2 is a front perspective exploded view of the chuck of FIG. 1.
Figure 3:
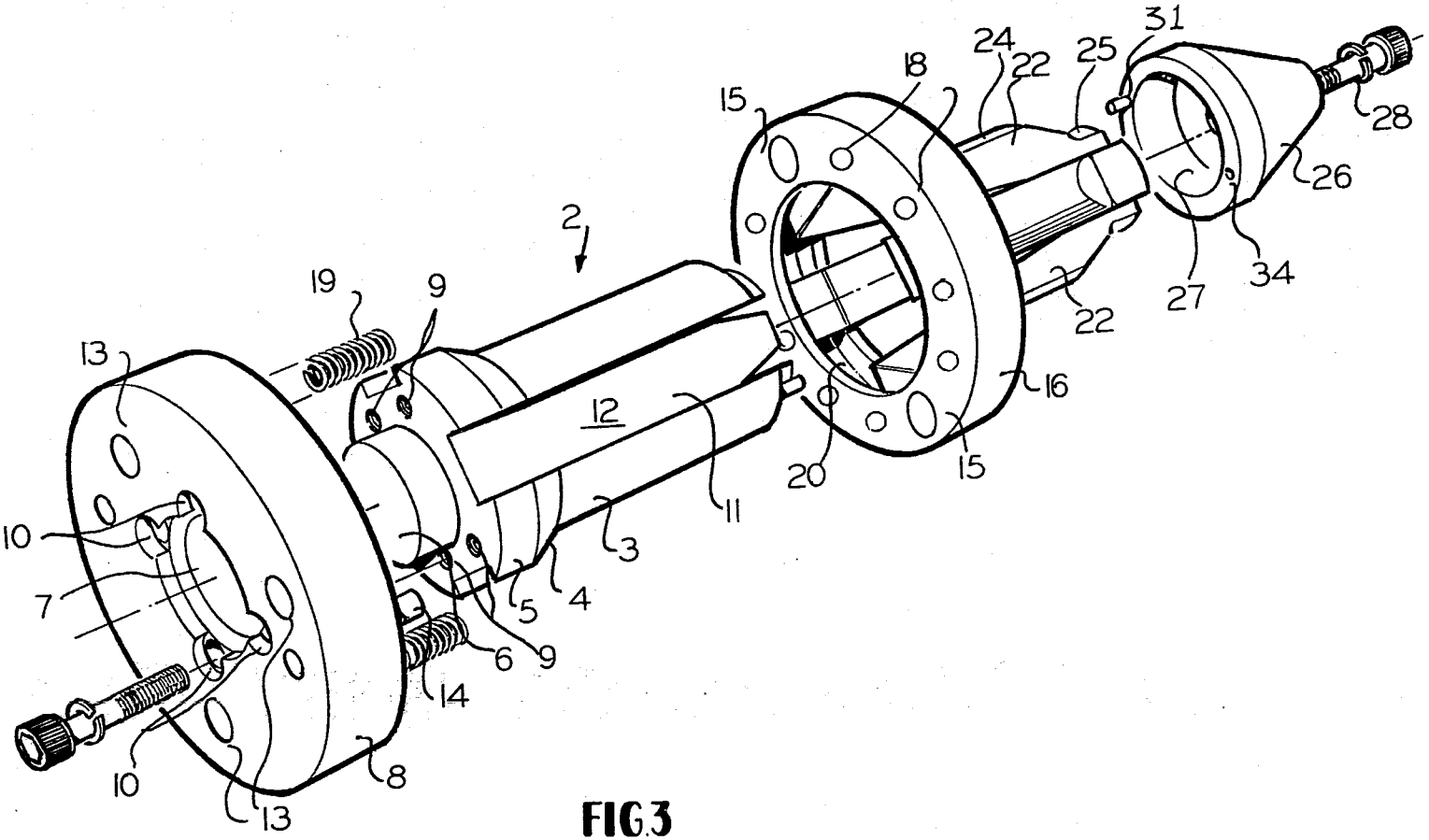
FIG. 3 is a rear perspective exploded view of the chuck of FIG. 1.

A chuck generally indicated at 1 comprises stub shaft means in the form of an essentially cylindrical body 2 having an elongate axially inner (with respect to the core of a roll to be engaged by the chuck) portion 3 of smaller diameter than said core internal diameter joined by a frusto-conical portion 4 to a portion 5 of greater diameter than said internal diameter. A boss 6 extends coaxially from the portion 5 for location in the bore 7 of an annular mounting flange 8. Four threaded blind bores 9 extend axially into the portion 5 at circumferentially spaced locations. These bores receive threaded bolts extending through bores 10 in mounting flange 8 to secure the body 2 and flange 8 together.

Four circumferentially equally spaced keyways 11 extend axially through the body 2 with their mounting surfaces comprising bases 12 planar and tangential to the axis of the body and inclined to diverge from said axis in the direction from the portion 3 to the portion 5.

The mounting flange 8 has three circumferentially spaced bores 13 extending axially therethrough at positions spaced radially outwardly of the body portion 5. These bores 13 are located and dimensioned to receive bolts for connecting the flange to mounting plates on a shaftless mill roll stand. A diametrically spaced pair of pins 14 extend axially forward from the flange 8 to be received in co-operating blind bores 15 in cone end abutment means in the form of an annular actuating member 16 slidably carried by the body 2. The flange 8 also has eight blind bores 17 circumferentially spaced and axially aligned with corresponding blind bores 18 in the annular member 16. Each aligned pair of bores 17 and 18 accommodate the respective ends of a spring means in the form of a compression spring 19 resisting axial movement of the annular member 16 towards the flange 8.

The annular member 16 has an internal diameter such that it is an axially sliding fit over the body portion 5. The member 16 has a circumferentially extending groove 20 in its radially inner surface to receive a radially projecting part 21 at the axially outer end of each of four movable jaw means (cylinder-engaging elements) in the form of sliding dogs 22 received in respective keyways 11.

Each dog 22 is of substantially triangular cross-section having an inclined planar radially inner surface 23 and a part-cylindrical radially outer surface 24 so that, with the surface 23 abutting the base 12 of the relevant keyway 11, said surface 24 extends axially. The curvature of surface 24 is selected such that the surface is an arc of a cylinder of the nominal internal diameter of the roll core. The axially inner end of each dog 22 has an inclined radially outer surface 25 which is convergent with the axis in the axially inner direction and which also has a part-cylindrical surface of greater curvature than the surface 24.

A cone 26 accommodates the axially inner ends of dogs 22 within a convergent frusto-conical recess 27 which extends about the surfaces 25. A central bore 28 extends through the cone 26 to receive a bolt 30 which extends into and is threadably received in a threaded central blind bore 29 in the body portion 3. The cone 26 has an axially extending pin 31 adapted to be received in a blind hole 32 at the axially inner end of the body 2. Similarly, a pin 33 extends axially forwards of said end of the body 2 to be received in a blind hole 34 diametrically opposed to said pin 31.

Figure 4:
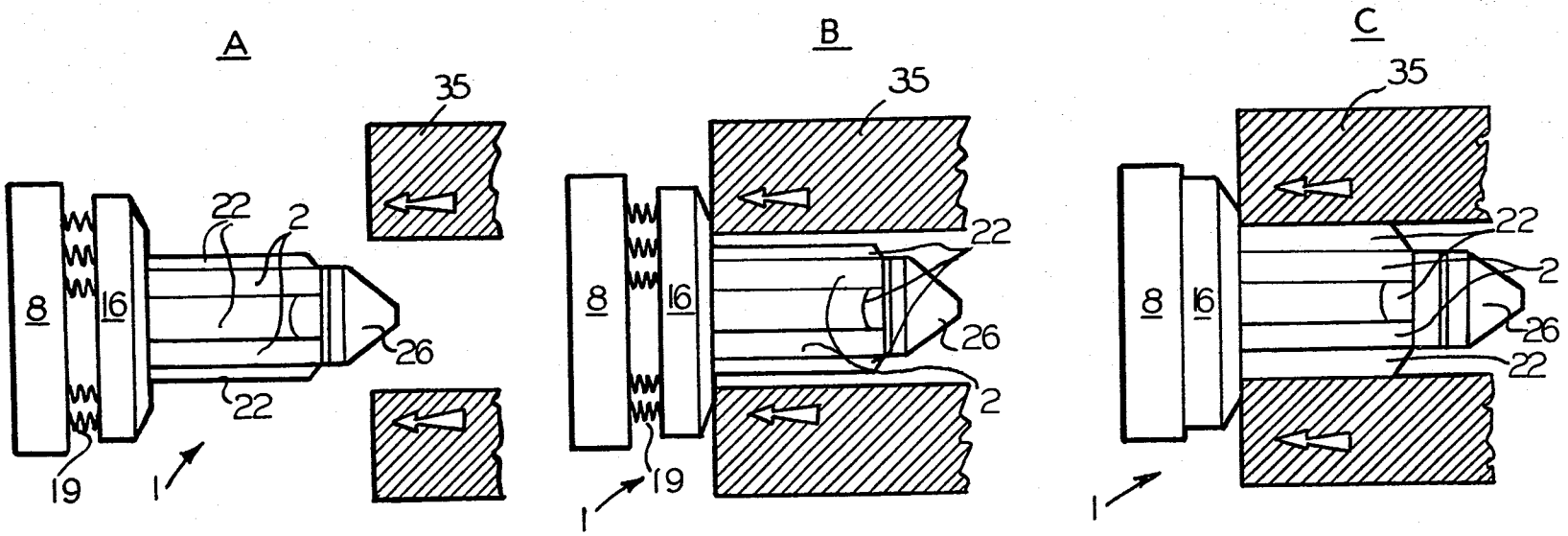
FIG. 4 is a sequence of three schematic drawings showing the method of operation of the chuck of FIG. 1.

In use, with the chuck 1 secured by flange 8 to a shaftless mill roll stand, the annular member is retained in a rearward position relative to flange 8 by the compression springs 19. The dogs 22 are retained in slide groove means provided by their respective keyways 11 by location of their projections 21 in groove 20 and of their distal ends in recess 27 which provide housing mean therefor. The chuck is moved by the drive mechanism of the mill roll stand axially into the core of a roll 35 of paper or like web material (see FIG. 4*a*). When the annular member 16 abuts the end of the core further axial movement of that member relative to the core is prevented (see FIG. 4*b*). Accordingly further axial movement of the body 2 causes relative axial movement between the flange 8 and member 16 against the bias of the springs 19. Such relative movement causes the dogs 22 to ride up the inclined surfaces 12 thereby moving the core-engaging surfaces 24 radially outwardly until they firmly abut the inner surface of the core. In this radially outer configuration of the dogs 22, the core is frictionally engaged with the chuck for rotation therewith (see FIG. 4*c*). Such engagement will not cause the core to split, allows for variations in internal core diameters from one roll to another of the same nominal internal diameter and secures the core at all speeds and during braking. When it is desired to remove the chuck 1 from the core, the body 2 is moved axially in the direction away from the core thereby allowing the annular member to return under the bias of springs 19 to its rearward position whence the dogs 22 will slide down the inclined surfaces 12 to reduce the extent of radial projection of surfaces 24 and permit complete removal of the chuck from the core.

It will be appreciated that the invention is not restricted to the details given above but that numerous modifications and alternations can be made without departing from the scope of the invention as defined in the following claims.

What we claim is:

1. An expanding chuck for engaging the inner surface of a hollow cylinder, which chuck comprises:

a rotatable body having peripherally spaced axially extending grooves providing peripherally spaced axially extending mounting surfaces inclined to the axis of rotation;

a plurality of cylinder-engaging elements mounted on said rotatable body in association with said mounting surfaces and adapted to be received within the hollow cylinder and having outer peripheral portions to engage the inner surface of the cylinder and being movable relative to said mounting surfaces between a radially inner configuration and a radially outer configuration to engage the inner surface of the cylinder at a plurality of peripherally spaced axially extending portions thereof;

actuating means, operatively associated with said elements, and providing an abutment surface extending radially outwardly beyond said outer peripheral portions of said elements and located for engagement with a side surface of the hollow cylinder during association of said elements within the hollow cylinder, for acting on said elements to move them relative to the mounting surfaces between said radially inner and outer configurations; and spring means for biasing said elements axially into their radially inner configuration.

2. An expanding chuck as claimed in claim 1, wherein the cylinder-engaging elements are in abutting engagement with and move axially over said support surfaces.

3. An expanding chuck as claimed in claim 1 adapted to engage the inner surface of a hollow cylinder of relatively small nominal internal diameter of between 3 inches and 4 inches.

4. An expanding chuck as claimed in claim 1 wherein the body is cylindrical.

5. An expanding chuck as claimed in claim 2 wherein the support surfaces diverge from the axis of rotation towards the axially outer end of the body.

6. An expanding chuck as claimed in claim 2 wherein the cylinder-engaging elements are of generally triangular shape in axial cross-section so that the radially outer surface of each element extends axially of the body throughout movement between the radially inner and outer configurations.

7. An expanding chuck as claimed in claim 6 wherein the said radially outer surface of each element is part-cylindrical.

8. An expanding chuck as claimed in claim 1 wherein the cylinder-engaging elements are equally spaced apart circumferentially of the axis of rotation.

9. An expanding chuck as claimed in claim 2 wherein the actuating means is an annular member slidably received on the body for axial movement relative thereto.

10. An expanding chuck as claimed in claim 9 wherein the cylinder engaging elements engage the annular member for axial movement therewith in the direction of the radially outer configuration of said elements.

11. An expanding chuck as claimed in claim 10 wherein the annular member has a radially extending recess or groove in which a radially extending projection of each cylinder-engaging element is located.

12. An expanding chuck as claimed in claim 9 wherein the spring means comprises helical compression springs acting between the annular member and the body.

13. An expanding chuck as claimed in claim 12 wherein the axially inner ends of the cylinder-engaging elements are slidably received in a conical end cap which is coaxially fixed to the body and converges in the axially outer direction.

14. Roll handling apparatus for releaseable supporting engagement with the interior surface of one end of an elongated hollow tubular core means or the like having a central longitudinal axis, said apparatus being adapted to be attached to rotatable support means for rotatably supporting the one end of the core means and materials mounted thereon in a suspended position relative thereto; and comprising:

a stub shaft means, having a central longitudinal axis, for supporting the one end of the core means with one end of the stub shaft means located therewithin and with the central longitudinal axis of the shaft means being substantially coaxial with the central longitudinal axis of the core means;

mounting means for attachment of the other supported end of said shaft means to the support means in fixed relationship thereto;

movable jaw means mounted on said shaft means for movement relative thereto between a first radially inwardly displaced core release position and a second radially outwardly displaced core supporting position;

spring means operatively associated with said jaw means for biasing said jaw means toward the core release position and for permitting movement of said jaw means toward the core supporting position;

core abutment means operatively associated with said jaw means and extending radially outwardly beyond said shaft means for abutting engagement with a side surface of the one end of the core means to cause movement of said jaw means from the core release position to the core supporting position against the bias of said spring means during insertion of the shaft means and the jaw means into the hollow interior of the one end of the core means;

the radial outward movement of said jaw means being caused by axially directed forces applied by the core means through said abutment means, the jaw means being maintained in the second radially outwardly displaced core supporting position by forces applied by the core means to said jaw means, and the radial inward movement of said jaw means being caused solely by forces applied by said spring means after removal of forces applied by the core means;

said movable jaw means comprising a plurality of core surface engaging-elements adapted to be received within the core means and to engage the interior surface of the core means; and groove means on said shaft means having peripherally spaced axially extending mounting surfaces for receiving and supporting said core surfce engaging-elements therewithin.

15. The invention as defined in claim 14 and wherein:

said mounting surfaces being inclined to the central longitudinally extending axis of said shaft means.

16. The invention as defined in claim 15 and wherein:

said mounting surfaces including first inclined base surfaces; and said core surface engaging-elements including second inclined base surfaces movably supported on said first inclined base surfaces and being movable axially relative thereto to cause movement of said core surface engaging-elements between said first radially inwardly displaced core release position and said second radially outwardly displaced core supporting position.

17. The invention as defined in claim 16 and wherein:

said core abutment means comprising an actuating member acting on said core surface engaging-elements to move them axially over said first inclined base surfaces between said first radially inwardly displaced core release position and said second radially outwardly displaced core supporting position.

18. The invention as defined in claim 17 and wherein:

the actuating member is slidably received on said shaft means for axial movement relative thereto.

19. The invention as defined in claim 18 and wherein:

said core surface engaging-elements engage said actuating member for axial movement therewith in the direction of movement toward the radially outwardly displaced core supporting position.

20. The invention as defined in claim 19 and wherein:

said actuating member has a radially extending recess in which a radially extending projection of each core surface engaging-element is located and operably connected to said actuating member.

21. The invention as defined in claim 20 and wherein: said spring means comprises compression springs acting between said actuating member and said mounting means.

22. The invention as defined in claim 21 and wherein: the axially inner ends of said core surface engaging-elements are slidably received in a conical end cap which is coaxially fixed to said shaft means and converges in the axially outer direction.

23. Roll handling apparatus for releasable supporting and gripping engagement with the interior surface of an elongated hollow tubular core means or the like, having a central longitudinal axis, said apparatus being adapted to be attached to support means for holding the hollow tubular core means and any materials mounted thereon in a suspended position relative thereto, and comprising:

shaft means, having a central longitudinal axis, for supporting the core means with the central longitudinal axis of the shaft means being substantially coaxial with the central longitudinal axis of the core means;

mounting means for attachment of said shaft means to the support means in fixed relationship thereto;

movable jaw means mounted on said shaft means for axial and radial movement relative thereto between a first axially outwardly radially inwardly displaced core release position and a second axially inwardly radially outwardly displaced core supporting and gripping position;

housing means mounted on said shaft means for movably supporting said movable jaw means relative to said shaft means for movement between said core release position and said core supporting and gripping position;

a portion of said housing means being axially movably mounted on said shaft means for axial movement between a first axially outwardly displaced core release position and a second axially inwardly displaced core supporting and gripping position;

said jaw means being connected to said portion of said housing means and being axially movable therewith;

spring means mounted between said portion of said housing means and said mounting means for biasing said portion of said housing means and said jaw means toward the core release position, and for permitting axial movement of said portion of said housing means and said jaw means toward the core supporting and gripping positions;

abutment means on said portion of said housing means extending transversely radially outwardly beyond said jaw means for abutting engagement with a side surface of the core means to cause axial inward displacement of said portion of said housing means and said jaw means from the core release positions to the core supporting and gripping positions against the bias of said spring means; and cam means on said shaft means and on said jaw means for causing radial outward displacement of said jaw means to the core supporting and gripping position during axial inward movement of said portion of said housing means and said jaw means, and for causing radial inward displacement of said jaw means to the core release position during axial outward movement of said portion of said housing means and said jaw means;

the axial inward movement of said portion of said housing means and said jaw means being caused solely by axially inwardly directed forces applied by the core means through said abutment means, and the axial outward movement of said portion of said housing means and said jaw means being caused solely by axially outwardly directed forces applied by said spring means to said portion of said housing means.

24. Apparatus for releasable supporting and gripping engagement with the inside surface of an elongated hollow tubular core member or the like having a central longitudinal axis, said apparatus being adapted to be attached to a supporting device for holding the hollow tubular core in a suspended position relative thereto and comprising:

shaft means for supporting the hollow tubular core in the suspended position;

movable jaw means mounted on said shaft means for gripping engagement with the inside surface of the core and being radially movable between a radially innermost position of disengagement relative to the core and variable radially outwardly spaced positions of supportive and gripping engagement within the core;

housing means mounted on said shaft means for movably supporting said movable jaw means and for limiting axial displacement of said jaw means relative to said housing means while enabling radial displacement of said jaw means relative to said housing means between the radially innermost position and the variable radially outwardly displaced positions;

mounting means associated with said shaft means for attachment of said apparatus to the supporting device;

slide groove means associated with said shaft means for axially slidably mounting said jaw means on said shaft means and for enabling axial slidable movement of said jaw means relative to said shaft means between an outwardly axially extended position whereat said jaw means is located in the radially innermost position and inwardly variably axially displaced retracted positions whereat said jaw means is located in the variable radially outwardly spaced positions;

cam means associated with said jaw means for actuating said jaw means between the radially innermost position and the variable radially outwardly displaced positions during axial slidable movement of said jaw means relative to said shaft means;

abutment means associated with said housing means for abutting engagement with the end surface of the core and for application of axially inwardly directed forces on said abutment means by the core; and spring means mounted between said housing means and said mounting means for biasing said housing means and said jaw means toward the outwardly axially extended position and for permitting axial displacement of said housing means and said jaw means between the outwardly axially extended position and the inwardly variable axially displaced retracted positions in response to axially inwardly directed forces applied to said jaw means and to said housing means by the core during supportive engagement of said jaw means with the core.

* * * * *